US006793533B2

(12) United States Patent
Berg et al.

(10) Patent No.: US 6,793,533 B2
(45) Date of Patent: Sep. 21, 2004

(54) ELECTRICAL CONNECTOR ASSEMBLY

(75) Inventors: Paul C. Berg, Batavia, IL (US); Frank T. Keyser, Elk Grove Village, IL (US)

(73) Assignee: Molex Incorporated, Lisle, IL (US)

( * ) Notice: Subject to any disclaimer, the term of this patent is extended or adjusted under 35 U.S.C. 154(b) by 578 days.

(21) Appl. No.: 09/924,772

(22) Filed: Aug. 8, 2001

(65) Prior Publication Data

US 2003/0032331 A1 Feb. 13, 2003

(51) Int. Cl.[7] ..... H01R 13/66
(52) U.S. Cl. ..... 439/620
(58) Field of Search ..... 439/620, 79, 736; 333/181–185; 29/858, 848, 849, 856, 883

(56) References Cited

U.S. PATENT DOCUMENTS 4,222,626 A * 9/1980 Hollyday et al. ..... 439/620
4,781,624 A * 11/1988 Shepherd ..... 439/620
5,145,413 A * 9/1992 Okamoto et al. ..... 439/620
5,236,376 A * 8/1993 Cohen ..... 439/620
5,599,208 A * 2/1997 Ward ..... 439/620
5,816,868 A * 10/1998 Legrady et al. ..... 439/876
5,842,888 A * 12/1998 Beloplsky ..... 439/620
6,007,387 A * 12/1999 Uchiyama ..... 439/736

* cited by examiner

*Primary Examiner*—Ross Gushi
(74) *Attorney, Agent, or Firm*—Stacey E. Caldwell

(57) ABSTRACT

An electrical connector assembly includes a dielectric housing having a mating end, a terminating end and a plurality of terminal-receiving passages extending in a direction between the ends. A termination subassembly is fixed to the terminating end of the housing. The termination subassembly includes a circuit board and a plurality of terminal pins extending through the circuit board and into the terminal-receiving passages in the housing. A plastic pin holder is overmolded about portions of the terminal pins at the terminating end of the housing and about at least a portion of the circuit board.

21 Claims, 2 Drawing Sheets

ELECTRICAL CONNECTOR ASSEMBLY

FIELD OF THE INVENTION

This invention generally relates to the art of electrical connectors and, particularly, to an electrical connector assembly which includes a plurality of terminals that must be held rigidly for termination purposes.

BACKGROUND OF THE INVENTION

Generally, a typical electrical connector includes some form of dielectric housing mounting a plurality of conductive terminals. The housing may include a mating end for interengaging a mating connector or other complementary connecting device, as well as a terminating end at which the terminals are terminated to various electrical transmission components ranging from circuit boards to discrete electrical wires.

One of the problems in fabricating or using electrical connectors is in holding or maintaining the terminating ends of the terminals sufficiently rigid so that they can be properly terminated to the complementary connecting devices. The terminals often are very small and fragile. An example is in a header connector which uses closely-spaced terminal pins.

For instance, the terminating ends of the terminal pins may be "wire bonded" to a plurality of discrete electrical wires. The wire bonding may be carried out by surface connection with the use of ultrasonic energy and the application of pressure. If the terminal ends of the very small terminal pins move to any extent, the energy dissipates and a good bond is not achieved. This problem is further magnified in filtered connectors where such components as ferrite blocks and/or flexible circuits having capacitor chips thereon are positioned over the terminal pins. All of these components must be held rigidly during the wire bonding process.

The present invention is directed to solving these problems and providing a very simple, efficient and effective system for holding terminals and related components rigidly on an electrical connector to facilitate termination of the terminals.

SUMMARY OF THE INVENTION

An object, therefore, of the invention is to provide a new and improved electrical connector assembly of the character described.

In the exemplary embodiment of the invention, the connector assembly includes a dielectric housing having a mating end, a terminating end and a plurality of terminal-receiving passages extending in a direction between the ends. A termination subassembly is fixed to the terminating end of the housing. The subassembly includes a circuit board and a plurality of terminal pins extending through the circuit board and into the terminal-receiving passages in the housing. A plastic pin holder is overmolded about portions of the terminal pins at the terminating end of the housing and about at least a portion of the circuit board.

According to one aspect of the invention, the overmolded plastic pin holder is fixed to the housing. The pin holder may be molded separately from the housing and subsequently mechanically attached thereto. Alternatively, the plastic pin holder may be molded integrally with the housing either at the same time that the housing is molded or thereafter. As disclosed herein, the circuit board comprises a flat flexible circuit.

According to another aspect of the invention, the termination subassembly includes a ferrite block through which at least some of the terminal pins extend. The plastic pin holder is overmolded about at least a portion of the ferrite block. The termination subassembly also may include a plurality of capacitors mounted on the circuit board and electrically connected to at least some of the terminal pins. The plastic pin holder is overmolded about the capacitors.

According to a further aspect of the invention, the terminal pins have contact ends at the mating end of the housing and termination ends exposed at a termination face of the plastic pin holder. The termination ends are formed by enlarged head portions of the pins which are flush with the termination face of the pin holder. As disclosed herein, the termination pins are square in cross-section, and the enlarged head portions comprise swaged ends of the pins. As disclosed herein, the connector is a header connector and the mating end of the housing is a shroud into which the contact ends of the terminal pins extend.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
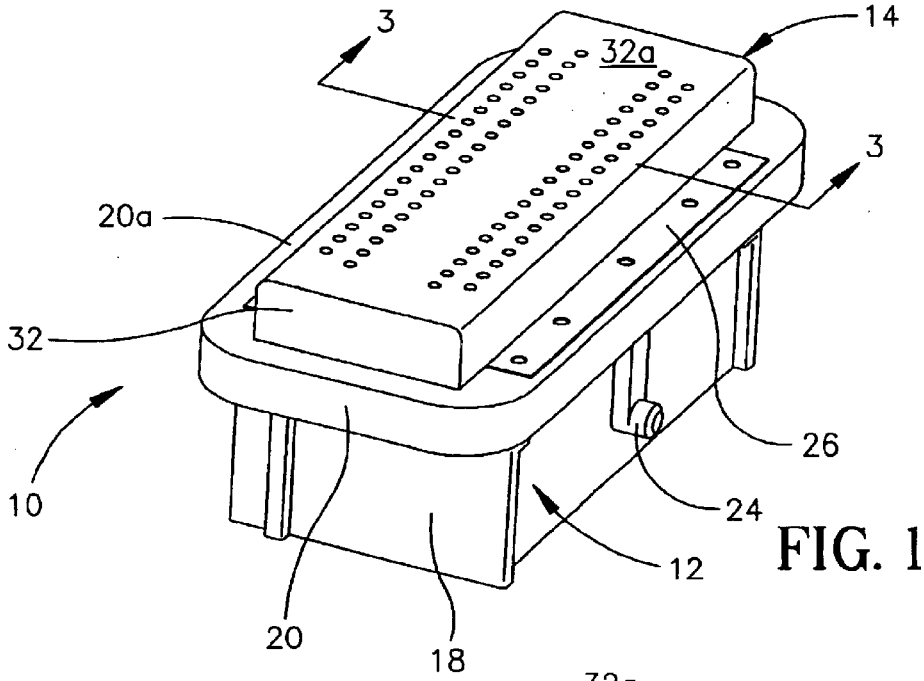
FIG. 1 is a perspective view of an electrical connector assembly embodying the concepts of the invention, looking at the terminating end thereof.
Figure 2:
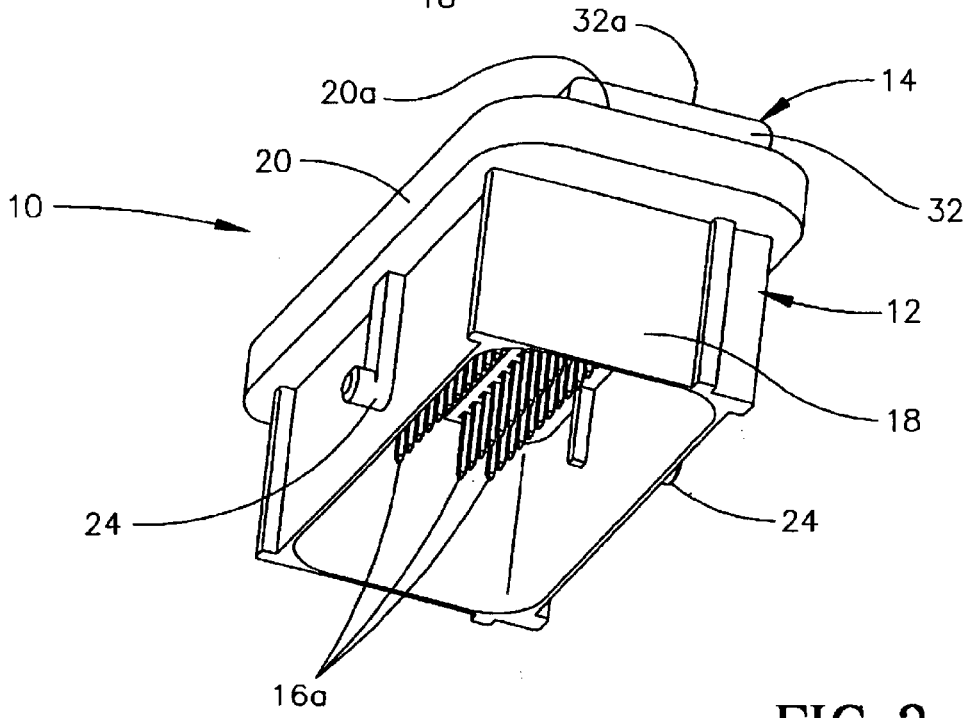
FIG. 2 is a perspective view of the connector assembly, looking at the mating end thereof.

Referring to the drawings in greater detail, the invention is embodied in an electrical connector assembly, generally designated 10, which is in the form of a header connector. The connector includes a dielectric housing, generally designated 12, and a termination subassembly, generally designated 14, including a plurality of terminal pins, generally designated 16 (FIG. 3).

Dielectric housing 12 of header connector 10 is a one-piece structure molded of plastic material or the like. The housing includes a mating end 18 in the form of a rectangular hollow shroud, and a terminating end 20 in the form of a flange which projects outwardly from the shroud. As seen in FIG. 3, mating end 20 forms the main body of the housing and closes the bottom of the shroud. A plurality of terminal-receiving passages 22 extend in a direction between the mating and terminating ends of the housing. An integral boss 24 projects outwardly from opposite sides of the shroud for facilitating mating the connector with a complementary mating connector, such as in a cam-type mating system. Terminating end 20 of housing 12 defines a generally flat surface 20*a* onto which termination subassembly 14 is mounted and fixed.

Figure 3:
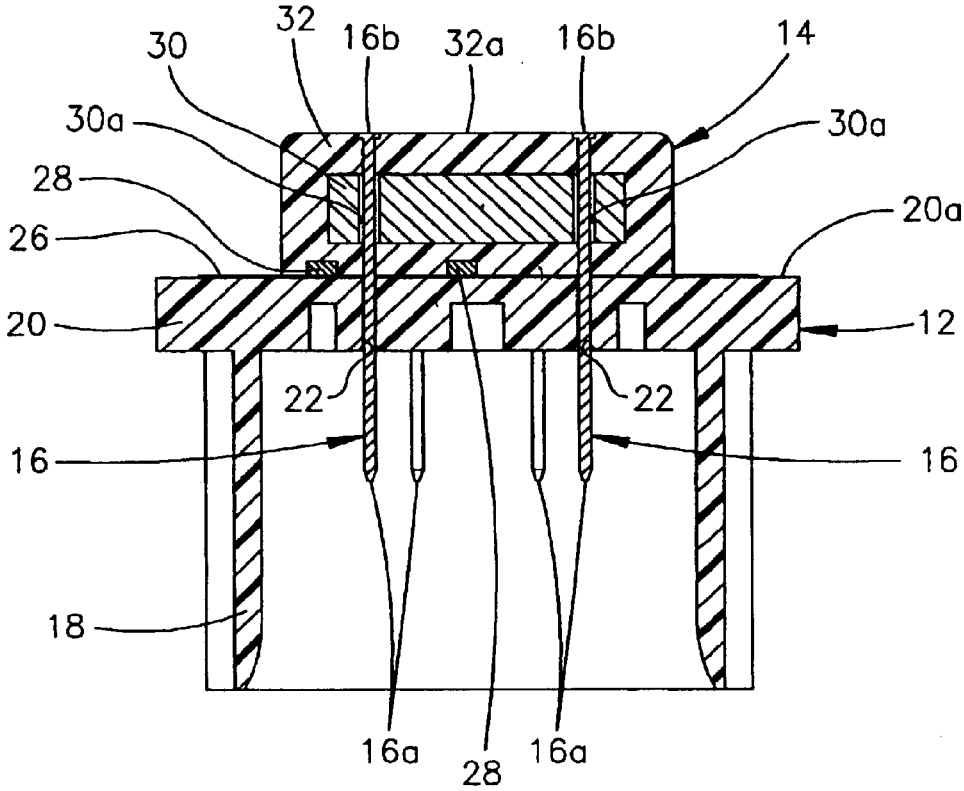
FIG. 3 is an enlarged vertical section taken generally along line 3—3 of FIG. 1.

Terminal pins 16 are best seen in FIG. 3 and extend through terminal-receiving passages 22 in housing 12. Each terminal pin includes a contact end 16*a* extending into shroud 18 of the housing, as well as a termination end in the form of an enlarged head portion 16*b*. Contact ends 16*a* will interengage with appropriate female terminals of the complementary mating connector. Enlarged head portions or termination ends 16*b* will be connected to discrete electrical wires as will be described hereinafter in relation to FIG. 4.

Terminating subassembly 14 of header connector 10 is best seen in FIGS. 1 and 3 and includes a circuit board in the form of a flat flexible circuit 26 juxtaposed against flat surface 20*a* of terminating end 20 of the housing. A plurality of capacitor chips 28 are mounted on the circuit board and are individually electrically coupled to terminal pins 16 through circuitry on the board. In the preferred embodiment, termination subassembly 14 also includes a ferrite block 30 surrounding terminal pins 16, with the pins extending through enlarged holes 30*a* in the ferrite block. All of the components of termination subassembly 14, including terminal pins 16, circuit board 26, capacitors 28 and ferrite block 30 are joined in rigid positional relationship by an overmolded plastic body or pin holder 32. In fabrication, the terminal pins, the circuit board including the capacitors and the ferrite block all can be held in proper relative positions in a molding die fixture whereupon plastic body or pin holder 32 is overmolded about the components to rigidly hold the components together in the termination subassembly.

It is contemplated that termination subassembly 14 can be fabricated at a location in a process independent of the fabrication of dielectric housing 12. The termination subassembly then can be assembled to the housing by inserting contact ends 16*a* of terminal pins 16 into terminal-receiving passages 22 of the housing. The termination subassembly then is fixed to the housing. For instance, plastic body or pin holder 32 can be mechanically attached, like ultrasonically welding to housing 20. It can be seen in FIG. 1 that the ends of the plastic body project beyond the ends of circuit board 26 whereby the body can be fixed to flat surface 20*a* of the housing. In addition, it can be seen in FIG. 1 that circuit board 26 projects beyond the sides of the plastic body or pin holder, and the circuit board, itself, can be electrically attached to a metal housing for grounding purposes.

It also is contemplated that the plastic body 32 of termination subassembly can be molded directly onto housing 12 after the housing is molded, whereby the housing, itself, will form part of the die fixture for overmolding the termination subassembly. Still further, plastic body or pin holder 32 can be molded integrally with or at the same time that the housing is molded.

Figure 4:
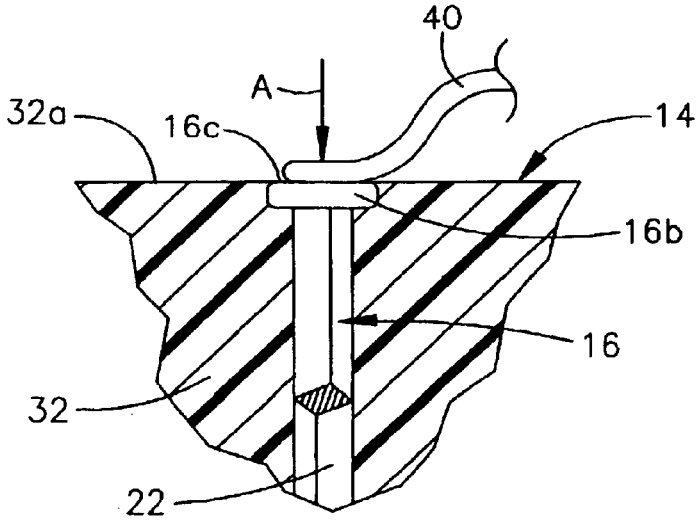
FIG. 4 is a fragmented, enlarged section through the head portion of one of the terminal pins overmolded by the plastic pin holder, and showing an electrical wire bonded to the head of the terminal pin.

FIG. 4 shows one of the terminal pins 16 overmolded by plastic body or pin holder 32 and connected to a discrete electrical wire 40. It can be seen that the pin is square in cross-section. Enlarged head portion 16*b* which forms the termination end of the terminal pin is "swaged" in a cold forming process to define a flat top surface 16*c* of the enlarged head portion. Plastic body 32 has a flat termination face 32*a*. During overmolding, flat surface 16*c* of the enlarged head portion of the terminal pin is maintained flush with termination face 32*a* of the overmolded plastic body. Electrical wire 40 is electrically coupled by a surface connection to top surface 16*c* of the terminal pin. This may be achieved by an ultrasonic wire bonding process embodying ultrasonic energy along with the application of pressure in the direction of arrow "A". With terminal pin 16, and particularly enlarged head portion 16*b* of the terminal pin, being completely surrounded by overmolded plastic body 32, the small terminal pin is rigidly held to ensure that a good wire bond is created between wire 40 and the terminal pin. If such rigidity is not maintained by the overmolded pin holder, the terminals have a tendency to move or shift and a good wire bond otherwise could not be assured.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly, comprising:

a dielectric housing having a mating end, a terminating end and a plurality of terminal-receiving passages extending in a direction between said ends; and a termination subassembly fixed to the terminating end of the housing, the termination subassembly including a circuit board, a plurality of terminal pins extending through the circuit board and into the terminal-receiving passages in the housing with the terminal pins having termination ends and mating ends at the mating end of the housing, a plurality of filters on the circuit board and electrically connected to at least some of the terminal pins, and a plastic pin holder overmolded about portions of the termination ends of the terminal pins leaving portions of the termination ends exposed at the terminating end of the housing, about the filters and about at least a portion of the circuit board, thereby rigidly supporting the termination ends of the terminal pins for connection to appropriate conductors.

2. The electrical connector assembly of claim 1 wherein said housing is molded of plastic material and said plastic pin holder is molded integrally therewith.

3. The electrical connector assembly of claim 1 wherein said circuit board comprises a flat flexible circuit.

4. The electrical connector assembly of claim 1 wherein said termination subassembly includes a ferrite block through which at least some of the terminal pins extend, and the plastic pin holder is overmolded about at least a portion of the ferrite block.

5. The electrical connector assembly of claim 1 wherein said filters comprise capacitors mounted on the circuit board.

6. The electrical connector assembly of claim 1 wherein said overmolded plastic pin holder is fixed to the housing.

7. The electrical connector assembly of claim 6 wherein said plastic pin holder is mechanically attached to the housing.

8. The electrical connector assembly of claim 7 wherein at least a portion of said circuit board is electrically attached to a metal housing.

9. The electrical connector assembly of claim 1 wherein said termination ends of the terminal pins are exposed at a terminal face of the plastic pin holder.

10. The electrical connector assembly of claim 9 wherein said termination ends of the terminal pins comprises enlarged head portions of the pins flush with the termination face of the pin holder.

11. The electrical connector assembly of claim 10 wherein said terminal pins are square in cross-section, and the enlarged head portions comprises swaged ends of the pins.

12. The electrical connector assembly of claim 1 wherein the mating end of said housing comprises a shroud into which the terminal pins extend.

13. An electrical connector assembly, comprising:

a dielectric housing having a mating end, a terminating end and a plurality of terminal-receiving passages extending in a direction between said ends; and a termination subassembly fixed to the terminating end of the housing, the termination subassembly including a circuit board, a plurality of terminal pins extending through the circuit board and into the terminal-receiving passages in the housing with the terminal pins having termination ends and mating ends at the mating end of the housing, a ferrite block through which at least some of the terminal pins extend, a plurality of capacitors mounted on the circuit board and electrically connected to at least some of the terminal pins, and a plastic pin holder overmolded about portions of the termination ends of the terminal pins leaving portions of the termination ends exposed at the terminating end of the housing, about at least a portion of the circuit board, about at least a portion of the ferrite block, and about the capacitors, the plastic pin holder rigidly supporting the termination ends of the terminal pins and having a termination face at which the termination ends of the terminal pins are exposed for connection to appropriate conductors.

14. The electrical connector assembly of claim 13 wherein said housing is molded of plastic material and said plastic pin holder is molded integrally therewith.

15. The electrical connector assembly of claim 13 wherein said circuit board comprises a flat flexible circuit.

16. The electrical connector assembly of claim 13 wherein the mating end of said housing comprises a shroud into which the terminal pins extend.

17. The electrical connector assembly of claim 13 wherein said overmolded plastic pin holder is fixed to the housing.

18. The electrical connector assembly of claim 17 wherein said plastic pin holder is mechanically attached to the housing.

19. The electrical connector assembly of claim 18 wherein at least a portion of said circuit board is electrically connected to a metal housing.

20. The electrical connector assembly of claim 13 wherein said termination ends of the terminal pins comprises enlarged head portions of the pins flush with the termination face of the pin holder.

21. The electrical connector assembly of claim 20 wherein said terminal pins are square in cross-section, and the enlarged head portions comprises swaged ends of the pins.

* * * * *